US007743461B2

(12) United States Patent
Carr et al.

(10) Patent No.: US 7,743,461 B2
(45) Date of Patent: Jun. 29, 2010

(54) VACUUM CLEANER WITH LARGE DEBRIS RECEPTACLE

(75) Inventors: Adam G. Carr, Grand Rapids, MI (US); Donald J. Mahaffy, Zeeland, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 642 days.

(21) Appl. No.: 11/549,406

(22) Filed: Oct. 13, 2006

(65) Prior Publication Data

US 2008/0086836 A1 Apr. 17, 2008

(51) Int. Cl.
*A47L 9/10* (2006.01)

(52) U.S. Cl. ..... 15/353; 15/347; 15/351

(58) Field of Classification Search ..... 15/350–353, 15/328, 329, 331, 337, 347
See application file for complete search history.

(56) References Cited

U.S. PATENT DOCUMENTS 4,249,280 A * 2/1981 Goodrich ..... 15/323
4,443,910 A * 4/1984 Fitzwater ..... 15/337
5,287,591 A * 2/1994 Rench et al. ..... 15/328
5,355,549 A * 10/1994 Steinberg et al. ..... 15/334
6,079,077 A * 6/2000 Kajihara et al. ..... 15/332
6,948,212 B2 * 9/2005 Oh et al. ..... 15/328
7,069,619 B2 * 7/2006 Bowden et al. ..... 15/335
7,213,297 B2 * 5/2007 Nam et al. ..... 15/334
2004/0211030 A1 * 10/2004 Nam et al. ..... 15/415.1

FOREIGN PATENT DOCUMENTS

GB 2395109 A 5/2004

* cited by examiner

*Primary Examiner*—Dung Van Nguyen
(74) *Attorney, Agent, or Firm*—McGarry Bair PC

(57) ABSTRACT

A vacuum cleaning machine comprising a housing that includes a suction nozzle that is adapted to move along a surface to be cleaned and a receptacle coupled to the housing for holding particles removed from the surface during operation of the vacuum cleaning machine. The receptacle is provided with an external opening for the introduction of debris particles therein which are not ordinarily removable from the surface through the suction-generating apparatus. The vacuum cleaning machine can be an upright vacuum cleaning machine and the receptacle can be mounted to the handle. The receptacle can also be incorporated into a dirt cup in a cyclone separator module.

8 Claims, 5 Drawing Sheets

VACUUM CLEANER WITH LARGE DEBRIS RECEPTACLE

BACKGROUND OF THE INVENTION

1. Field of the Invention

The invention relates to a vacuum cleaner. In one of its aspects, the invention relates to a vacuum cleaner with a facility for collecting large debris particles that are not ordinarily picked up by the suction nozzle.

2. Description of the Related Art

There is typically an upper limit to the size and weight of the dirt and debris particles that can be removed by the vacuum cleaner from a surface to be cleaned. Attempting to use the vacuum cleaner to remove such particles can have deleterious results, such as clogging of the air flow system, jamming of the motor, fracture of vacuum cleaner components, and the like.

Alternatively, the particle can be removed by hand prior to passing the vacuum cleaner over the surface. However, it is then necessary to transport the particle for disposal, thereby interrupting the vacuuming operation, or find a place to temporarily hold the particle until it can be permanently disposed, such as placing it on an item of furniture, in a user's pocket, or in a user's hand. This can be burdensome, particularly if several such particles must be removed, unsanitary, and still requires the user to specially dispose of the particle.

SUMMARY OF THE INVENTION

According to the invention, a vacuum cleaner comprises a housing that includes a suction nozzle that is adapted to move along a surface to be cleaned, an air/dirt separator to remove dirt from air, a working air conduit between the suction nozzle and the air/dirt separator and a dirt receptacle in communication with the air/dirt separator for receiving debris removed from air in the air/dirt separator, and a suction source fluidly connected to the suction nozzle, the working air conduit, the air/dirt separator and the dirt receptacle for moving dirt-laden air from the suction nozzle through the working air conduit and through the dirt separator, wherein at least one of the working air passage, the dirt separator and the dirt receptacle has an external opening for the introduction of debris particles which are not ordinarily removable from the surface to be cleaned through the suction nozzle.

In accordance with one embodiment of the invention, the external opening is selectively sealed by a closure element. Preferably, wherein the closure element is a door which is mounted for movement between a sealed position overlying the external opening and an open position providing external access through the external opening. The door can be pivotally mounted for rotational movement between the open and sealed positions, sliding movement with respect to the housing element or simply removing the door from the housing. The door is preferable releasably fixed over the external opening when the door is in the sealed position.

In one embodiment, the external opening is positioned in the dirt receptacle. In anther embodiment, the external opening is in the air/dirt separator comprises a cyclone separator and wherein the external opening is positioned in the cyclone separator. In still another embodiment, the external opening is positioned in the working air conduit.

The housing can include a base that is adapted to move across the surface to be cleaned and an upright portion that is pivotally mounted to the base, and the dirt receptacle can be mounted to the upright portion. The air/dirt separator can include a cyclone separator and the dirt receptacle can be mounted beneath the cyclone separator.

In one embodiment of the invention, a chute is mounted to the upright portion and has an open upper end at an upper portion of the upright portion and an open lower portion in communication with the external opening in the dirt receptacle. In this embodiment, door is mounted adjacent to open upper end for selectively sealing the open upper end of the chute.

In another embodiment, a funnel can be mounted to the dirt receptacle in communication with the external opening in the dirt receptacle.

Further according to the invention, a vacuum cleaner comprises a housing that includes a suction nozzle that is adapted to move along a surface to be cleaned, an air/dirt separator to remove dirt from air, a working air conduit between the suction nozzle and the air/dirt separator and a dirt receptacle in communication with the air/dirt separator for receiving debris removed from air in the air/dirt separator, and a suction source fluidly connected to the suction nozzle, the working air conduit, the air/dirt separator and the dirt receptacle for moving dirt-laden air from the suction nozzle through the working air conduit and through the dirt separator, and a debris collector mounted to the housing for the placement of debris which is not ordinarily removable from the surface to be cleaned through the suction nozzle.

In one embodiment, the housing includes a base that is adapted to move across the surface to be cleaned and an upright portion that is pivotally mounted to the base and the debris collector is mounted to the upright portion. In another embodiment, the dirt separator comprises a cyclone separator and the debris collector is positioned on the cyclone separator. In another embodiment, the debris collector is positioned on the working air conduit. In still another embodiment, the debris collector is positioned on the dirt collector.

DESCRIPTION OF AN EMBODIMENT OF THE INVENTION

Figure 1:
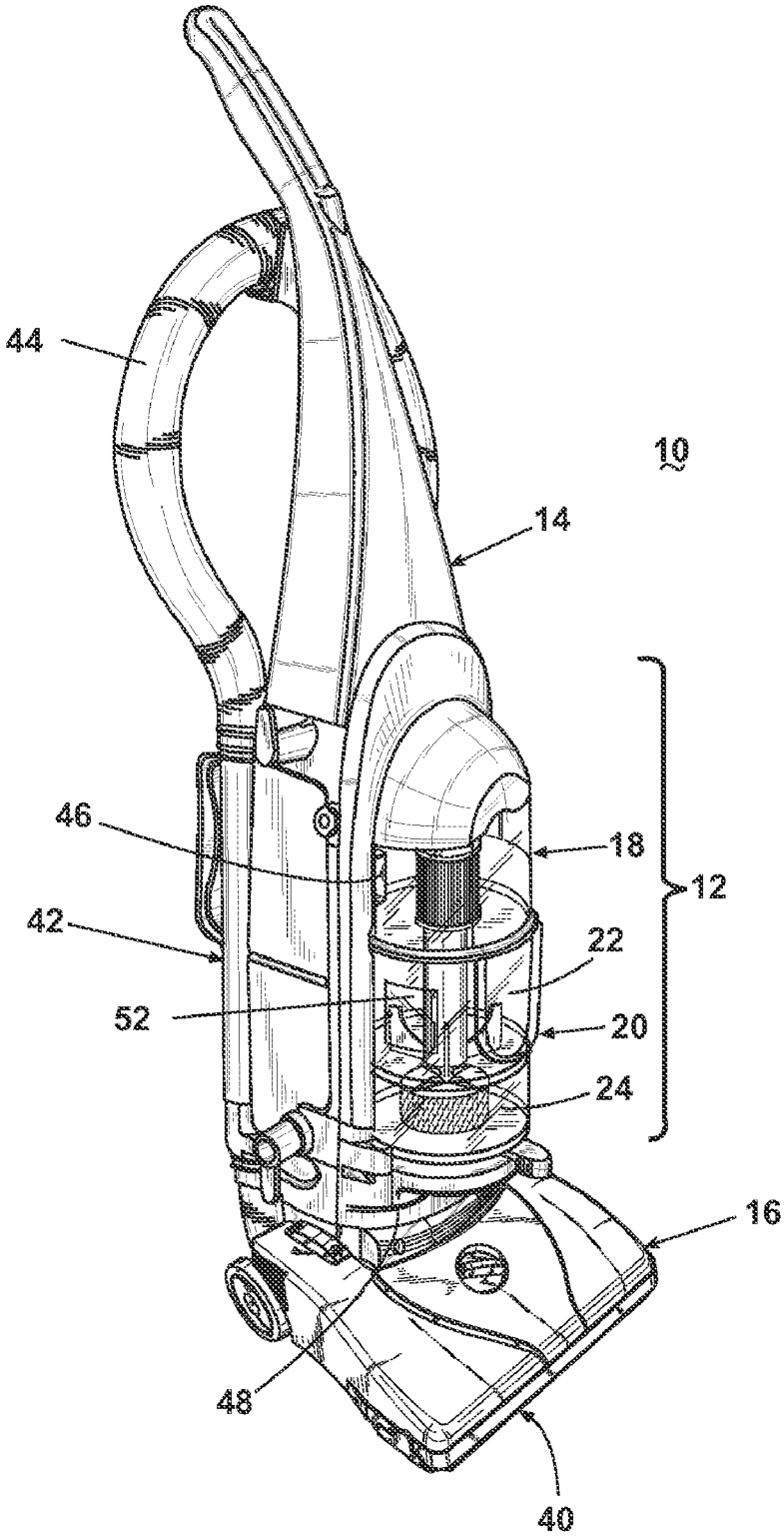
FIG. 1 is a perspective view of a first embodiment of the invention as embodied in an upright vacuum cleaner with a cyclonic dirt separator and dirt cup assembly having a large particle receptacle according to the invention.

Referring now to the drawings and to FIG. 1 in particular, an upright vacuum cleaner 10 comprises a housing that includes an upright portion 14 pivotally mounted to a nozzle base housing 16 at a lower end thereof. The base 16 has a suction nozzle 40 that is that is adapted to move along a surface to be cleaned. The upright portion 14 includes a cyclonic air/dirt separator and dirt cup assembly 12 comprising a cyclonic air/dirt separator 18 to remove dirt from air and a dirt cup assembly 20 to collect dirt and debris that is separated from air in the air/dirt separator assembly 18. The dirt cup assembly 20 is removably mounted to the upright portion 14 and comprises a dirt cup 22 and a filter chamber 24. The housing further includes a working air conduit 42, including a hose 44, between the suction nozzle 40 and the air/dirt separator 18 through an inlet opening 46 in the air/dirt separator 18. The dirt cup 22 is in communication with the air/dirt separator 18 for receiving debris removed from air in the air/dirt separator 8. A suction source 48, typically a motor and fan assembly (not shown), within the upright portion 14 is fluidly connected to the suction nozzle 40, the working air conduit 42, the air/dirt separator 18 and the dirt cup 22 for moving dirt-laden air from the suction nozzle 40 through the working air conduit 42 and through the air/dirt separator 18. The vacuum cleaner 10 shares features and operation of a well-known upright vacuum cleaner, which will not be described in detail herein except as necessary for a complete understanding of the invention. In a known manner, air is exhausted from the filter chamber 24, thereby drawing air through an inlet opening 38 (FIG. 2) into the cyclonic separator assembly 18 from beneath the nozzle base housing 16. Dirt particles suspended in the air entering the cyclonic separator assembly 18 are introduced in a known manner into the dirt cup 22 where they are accumulated until disposed of.

Figure 2:
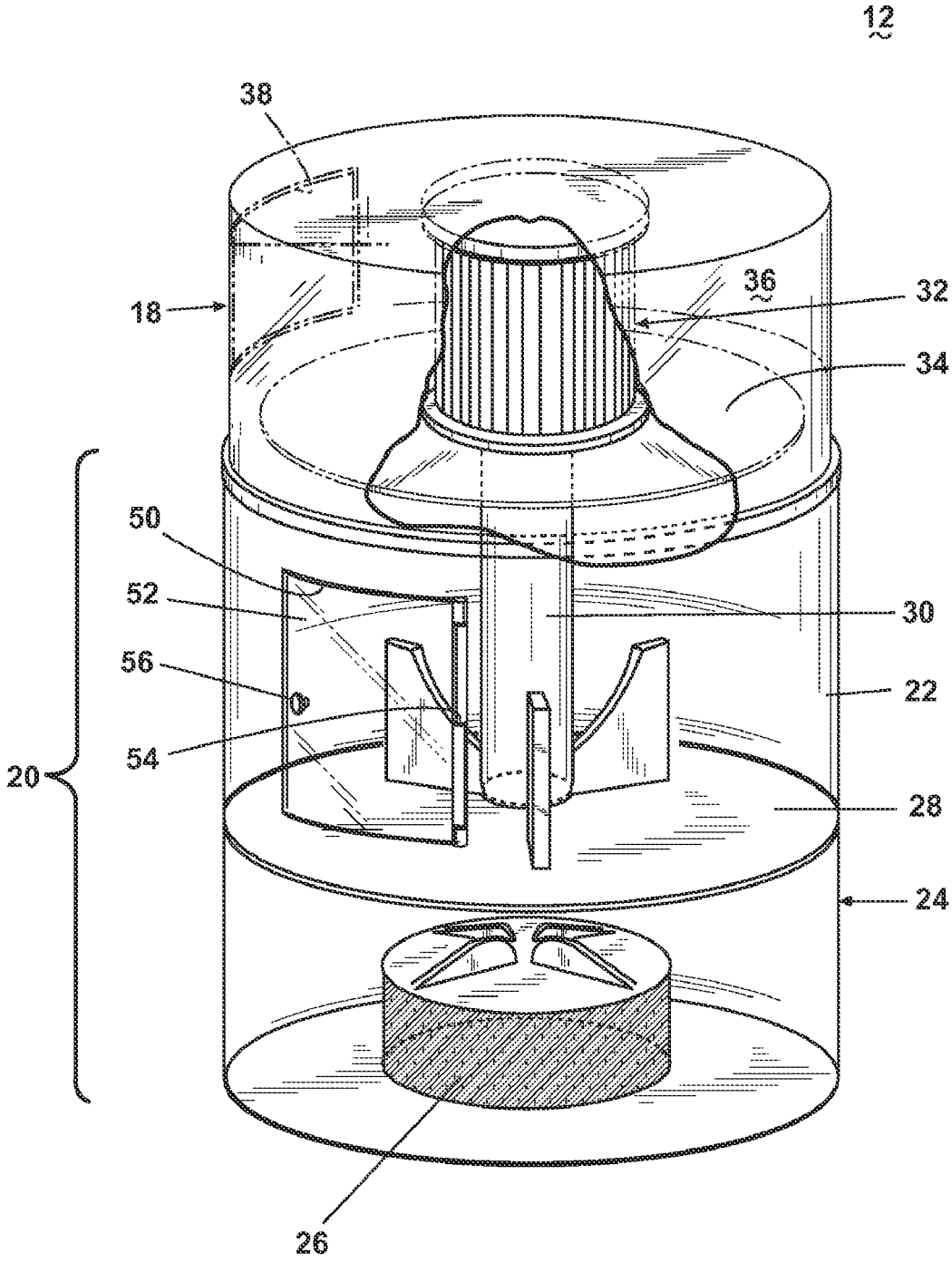
FIG. 2 is an enlarged view of the cyclonic dirt separator and dirt cup assembly shown in FIG. 1.

The cyclonic dirt separator and dirt cup assembly 12 can comprise an assembly such as disclosed in U.S. Pat. No. 7,651,544 to Fester et al., issued Jan. 26, 2010, entitled "Vacuum Cleaner With Multiple Cyclonic Dirt Separators And Bottom Discharge Dirt Cup", which is incorporated by reference herein in its entirety. As illustrated in FIG. 2, the cyclonic separator assembly 18 is a generally cylindrical chamber which can be separated from the dirt cup 22 through a separator plate or baffle 34 to facilitate the deposition and retention of the dirt particles in the dirt cup 22. Alternatively, the cyclonic separator assembly 18 and the dirt cup 22 can comprise a generally continuous, unitary chamber adapted to contain suspended particles in an upper portion and deposited particles in a lower portion. The cyclonic separator assembly 18 comprises a chamber 36 having a cylindrical exhaust assembly 32 fluidly connected through a standpipe 30 extending through the dirt cup 22 to the filter chamber 24. The filter chamber 24 can be provided with a filter element 26 and separated from the dirt cup 22 by a separator wall 28.

An opening 50 is provided into the interior of the dirt cup 22 having dimensions suitable for insertion therethrough of large debris particles which may be encountered during cleaning operations, such as bottle caps, paper clips, glass fragments, and the like. The opening 50 can be closed by a door 52 movably attached to the dirt cup 22 through suitable means, such as a hinge 54, and having a handle 56 to facilitate opening and closing of the door 52. Other attachment methods, such as an interference fit, flanges, a sliding mechanism, and the like, can be utilized. Preferably, the joint between the door 52 and the opening 50 is provided with a means for sealing the joint against the flow of air, such as a gasket (not shown).

Large debris particles encountered during vacuum operations can be retrieved from the surface to be cleaned, and introduced into the dirt cup 22 through the opening 50. The debris particles will be retained within the dirt cup 22 until the dirt cup is emptied, and will not adversely affect the air flow through the vacuum cleaner or the vacuum-generating mechanism.

Figure 3:
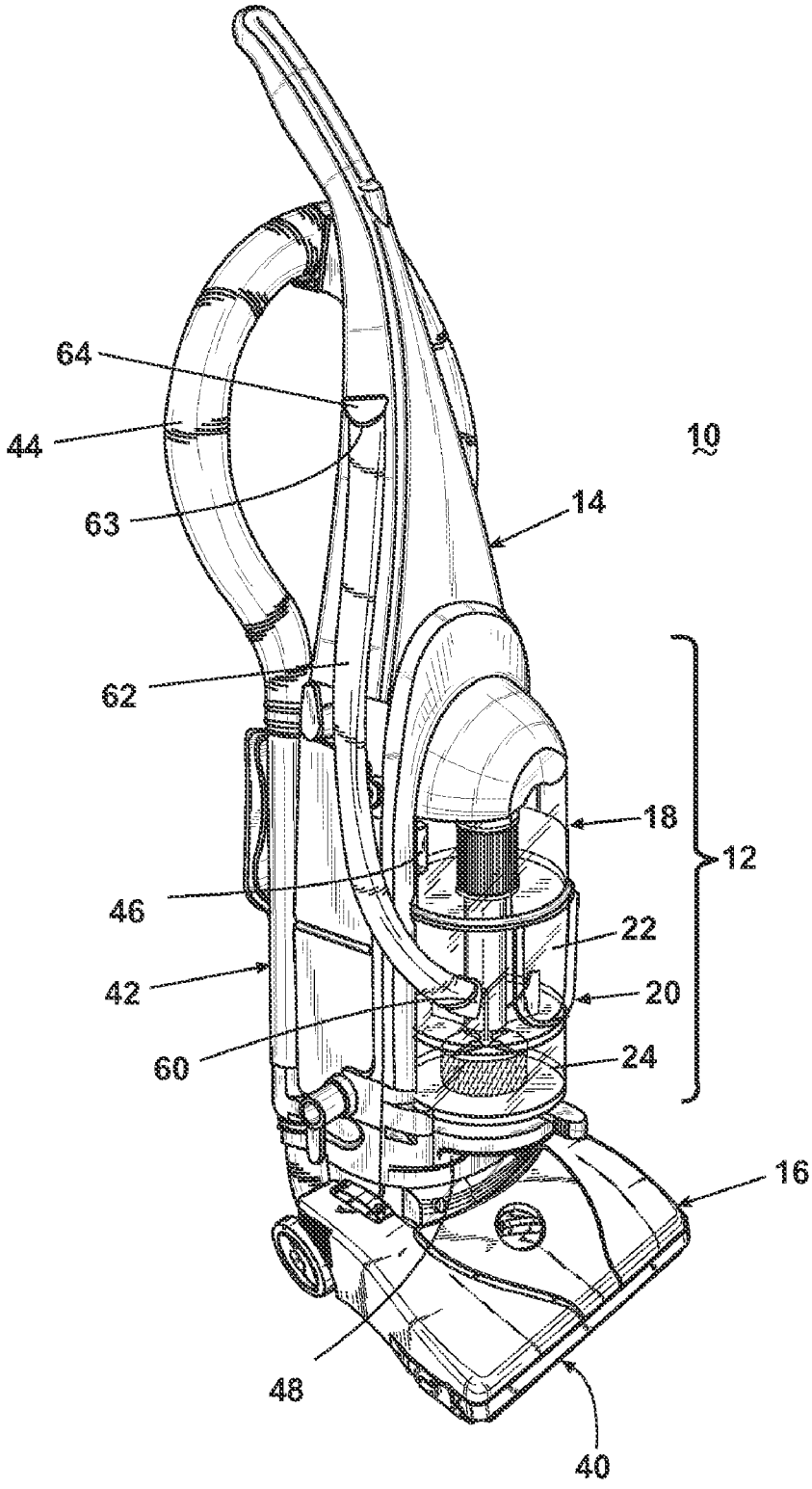
FIG. 3 is a perspective view similar to FIG. 1 of an upright vacuum cleaner comprising a second embodiment according to the invention.

FIG. 3 illustrates a second embodiment of the large debris receptacle in which an opening 60 is provided into the dirt cup 22. However, the opening 60 is fluidly connected to an enclosed chute 62 which extends from the dirt cup 22 along the upright portion 14 to terminate in an opening 63 having a door 64 for opening and closing the chute 62. The dimensions of the openings 60, 63 and the chute 64 are suitable for insertion therethrough of large debris particles. The door 64 can be provided with a gasket for sealing the opening 63 against the flow of air.

Figure 4:
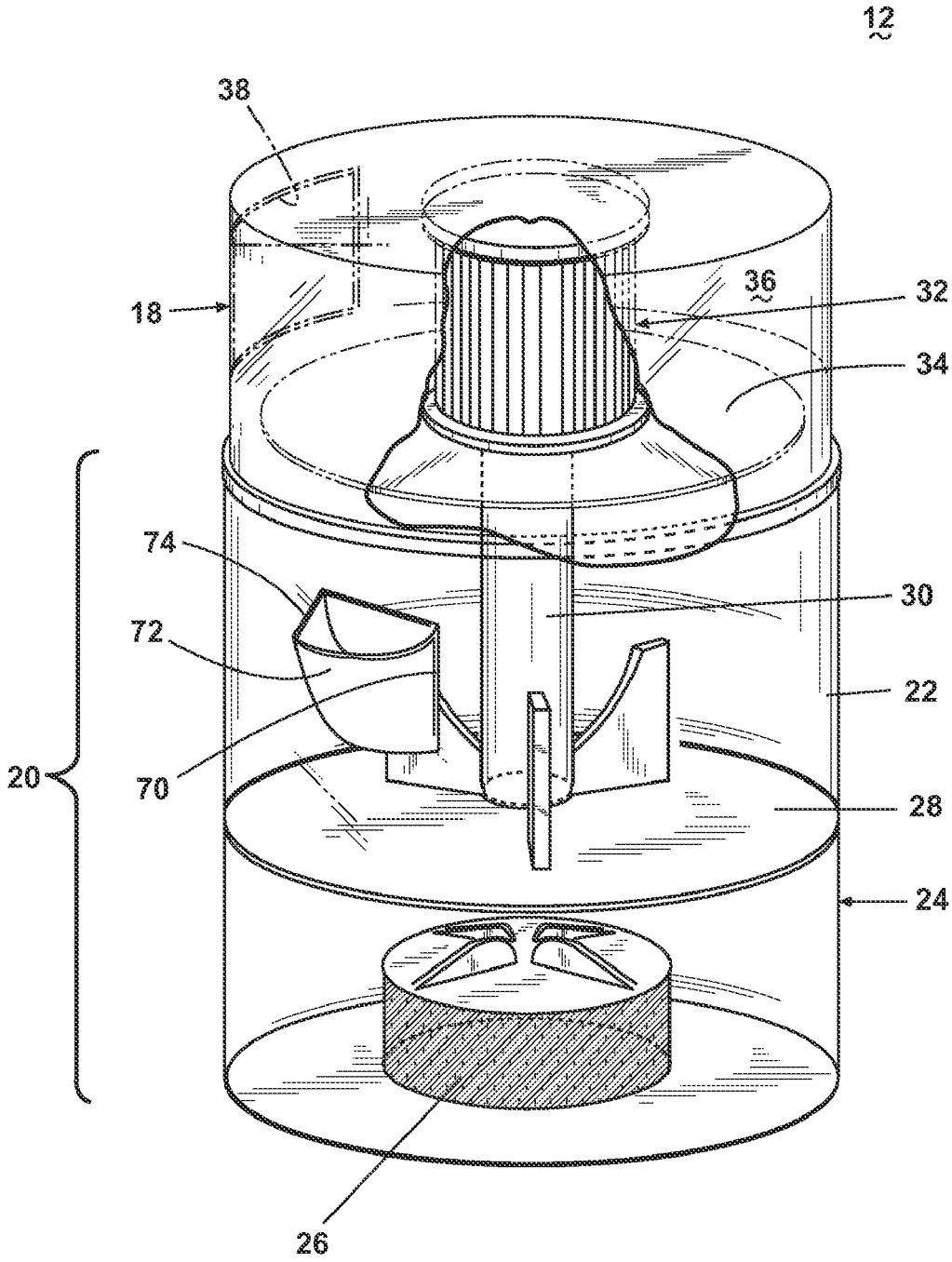
FIG. 4 is an enlarged view similar to FIG. 2 of a cyclonic dirt separator and dirt cup assembly comprising a third embodiment according to the invention.

FIG. 4 illustrates a third embodiment of the large debris receptacle in which an opening 70 is provided into the dirt cup 22. A funnel 72 is attached to the side of the dirt cup 22 and fluidly connected to the interior of the dirt cup 22 through the opening 70. The funnel 72 has an opening 74 having dimensions, with the opening 70, suitable for insertion therethrough of large debris particles. Alternatively, the opening 74 can be provided with a door (not shown).

Figure 5:
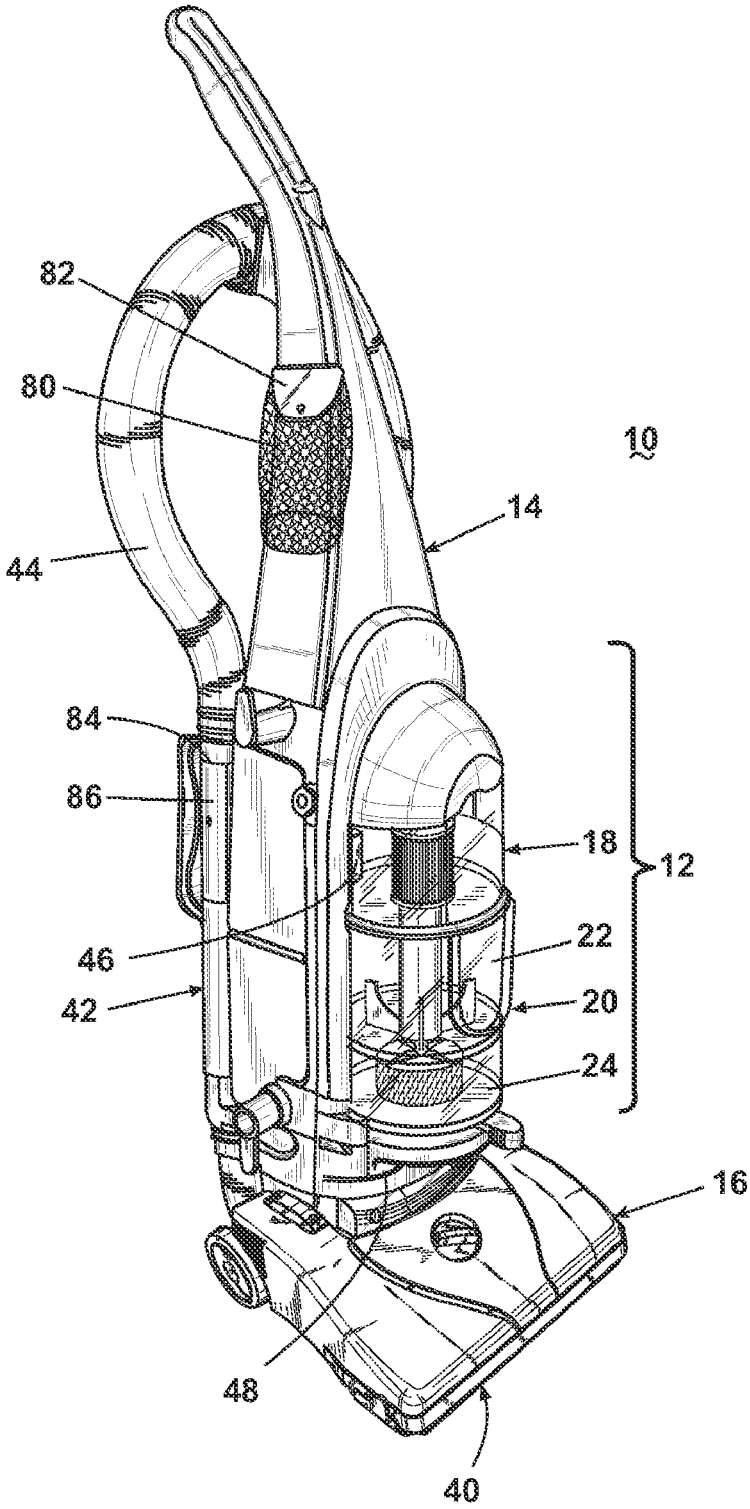
FIG. 5 is a perspective view similar to FIG. 1 of an upright vacuum cleaner comprising fourth and fifth embodiments of the invention.

FIG. 5 illustrates a fourth embodiment of the large debris receptacle comprising a container 80 such as a small receptacle, mesh container, mesh bag, and the like, attached to an upper portion of the upright portion 14. The container 80 is not connected to the dirt cup 22. The container 80 can be provided with a movable cover 82 for closing the container 80, and can be sized to accommodate a preselected volume of large debris particles that may be encountered during vacuuming operations. The container 80 is removably attached to the upright portion 14 to facilitate emptying the container 80 of its contents.

FIG. 5 also illustrates an external opening 84 in the working air conduit 42 for introduction into the working air conduit of larger debris that is not ordinarily picked up by the suction nozzle 40. The external opening 84 is selectively sealed with a hinged door 86 in a manner disclosed for the door 52 in the embodiment of FIG. 2.

The large debris receptacle described herein provides a convenient and readily accessible means of holding the large debris particles encountered during vacuuming operations which cannot be removed from the surface to be cleaned by the vacuum cleaner itself. Large debris particles can be introduced directly into the dirt cup of the vacuum cleaner, to be disposed of when the dirt cup is emptied, thereby facilitating the proper removal and disposal of the large debris particles.

While the invention has been specifically described in connection with certain specific embodiments thereof, it is to be understood that this is by way of illustration and not of limitation. For example, the invention has been described with respect to an upright vacuum cleaner with a cyclone separator. The invention can also be used with bag filter vacuum cleaners and with canister vacuum cleaners as well as upright vacuum cleaners. Reasonable variation and modification are possible within the scope of the forgoing disclosure and drawings without departing from the spirit of the invention which is defined in the appended claims.

What is claimed is:

1. A vacuum cleaning machine comprising:

a housing that includes a suction nozzle that is adapted to move along a surface to be cleaned;

an air/dirt separator to remove dirt from air;

a working air conduit between the suction nozzle and the air/dirt separator;

a dirt receptacle in communication with the air/dirt separator for receiving debris removed from air in the air/dirt separator, the dirt receptacle having an external opening; and a suction source fluidly connected to the suction nozzle, the working air conduit, the air/dirt separator and the dirt receptacle for moving dirt-laden air from the suction nozzle through the working air conduit and through the dirt separator;

wherein the external opening can enable the introduction of debris particles which, due to size or configuration, cannot be removed by the vacuum cleaning machine from the surface to be cleaned.

2. A vacuum cleaning machine according to claim 1 wherein the external opening is selectively sealed by a closure element.

3. A vacuum cleaning machine according to claim 2 wherein the closure element is a door which is mounted for movement between a sealed position overlying the external opening and an open position providing external access through the external opening.

4. A vacuum cleaning machine according to claim 3 wherein the door is pivotally mounted for rotational movement between the open and sealed positions.

5. A vacuum cleaning machine according to claim 1 wherein the housing includes a base that is adapted to move across the surface to be cleaned and an upright portion that is pivotally mounted to the base and the dirt receptacle is mounted to the upright portion.

6. A vacuum cleaning machine according to claim 5 wherein the air/dirt separator comprises a cyclone separator and the dirt receptacle is mounted beneath the cyclone separator.

7. A vacuum cleaning machine according to claim 1 wherein the air/dirt separator comprises a cyclone separator and the dirt receptacle is mounted beneath the cyclone separator.

8. A vacuum cleaning machine according to claim 1 wherein the air/dirt separator comprises a cyclone separator and wherein the external opening is positioned in the cyclone separator.

* * * * *